United States Patent [19]

Hulbert, Jr.

[11] 4,142,229

[45] Feb. 27, 1979

[54] METHOD OF SHAPING A LAMP BEAM

[76] Inventor: Clarence E. Hulbert, Jr., 1549 E. Houston St., Muskogee, Okla. 74401

[21] Appl. No.: 799,303

[22] Filed: May 23, 1977

[51] Int. Cl.[2] ..... F21V 29/00

[52] U.S. Cl. ..... 362/292; 362/64; 362/305; 362/309; 362/338; 362/354; 156/252

[58] Field of Search ..... 362/64, 290–292, 362/305, 309, 338, 354; 156/252

[56] References Cited

U.S. PATENT DOCUMENTS

| | | | |
|---|---|---|---|
| 1,371,179 | 3/1921 | Mattox | 362/292 X |
| 1,561,417 | 11/1925 | Droll | 362/305 X |
| 1,654,974 | 1/1928 | Johnson | 362/292 |
| 1,804,719 | 5/1931 | Timmons | 362/354 |
| 1,812,779 | 6/1931 | Geary | 362/354 |
| 2,830,174 | 4/1958 | Gagnier | 362/292 |

*Primary Examiner*—Peter A. Nelson
*Attorney, Agent, or Firm*—William S. Dorman

[57] ABSTRACT

A method of altering the photometric output and distribution of a light beam produced by a lamp having a fluted sealed beam lamp lens cover, the light beam having a certain beam shape which, in the absence of the present invention, does not conform to the photometric specifications for auxiliary low beam automobile head lamps; the latter specifications require the lamps to have specific maximum and minimum candela(s) output at various photometric points within the beam pattern.

Specific areas of certain flutes molded into the lens cover of a non-conforming sealed beam lamp are partially or totally covered with an opaque material or obstructed by a shield to restrict the candela output of unwanted light at various photometric points within the beam pattern, and thus permit the total beam pattern of the treated lamp to meet state and Federal photometric specifications for auxiliary low beam automobile headlamps.

5 Claims, 6 Drawing Figures

METHOD OF SHAPING A LAMP BEAM

BACKGROUND OF THE INVENTION

1. Field of the Invention

The invention relates to a means of reshaping light beams transmitted from the fluted lens cover of a sealed beam lamp to permit the lamp to conform to certain photometric specifications pertaining to automobile lamps. More particularly, the invention relates to a method of shaping lamp beams to certain specifications by progressively covering the individual flutes molded within the lens cover to determine the location of the respective flutes or portions of individual flutes which are contributing unwanted light.

2. Description of the Prior Art

The Society for Automotive Engineers (hereinafter referred to as SAE) over 40 years ago promulgated a series of recommended practices for automobile headlamps and other lights associated with the automobile, related to the safety aspects of lights. The objective was to set a series of photometric, mechanical and durability tests, and procedures for those tests, which have been adapted by the original equipment Automotive manufacturers. Recently, the states and Federal Government became safety conscious and have adopted the recommended practices of the SAE and enacted laws to govern the specifications of automobile lights.

The fifty states and Canadian provinces have formed an association called American Association of Motor Vehicle Administrators (hereinafter called AAMVA). The AAMVA acts as a central clearing house for all member states so manufacturers only need to gain certified approval from AAMVA to be legal in the states and provinces.

The California Highway Patrol (hereinafter called CHP) was the first state to become a stringent enforcer of the SAE regulations along with additional standards they set as regulations that were adopted into law. The final outcome was a general set of rules and regulations adopted by the various agencies that have set standard specifications adopted by all states to legally regulate the design and manufacture of specific automobile lights.

It is not necessary that lights for automobiles be of a sealed beam lamp type to be accepted as long as they meet photometric standards. However, it has been proven that sealed beam lamps are more practical to manufacture and maintain.

Standards set forth for specific types of sealed beam lamps are in most cases easily met, but in the case of auxiliary low beam and passing lamps, the specifications are so rigid that manufacturers have been unable to design a sealed beam fluted lens cover for a lamp that will consistantly meet the photometric specifications.

In a strict geometric-optical sense the sealed beam lamp cover represents more than just a simple lens, which is defined as an optical system bounded by two refracting surfaces having a common axis. The sealed beam lamp lens cover is composed of a number of different optical light control elements, such as prisms or cylindrical lenses positioned in either vertical or horizontal planes and molded into the glass cover. These light control elements are commonly called flutes.

As is known to those skilled in the art, all of the attempts by varying flute patterns and flute shapes in the sealed beam lamp lens cover have thus far proven futile in perfecting a lamp which meets the auxiliary low beam automobile head lamps SAE J582a specifications. The auxiliary low beam specification (SAE J582a) is referred to herein by way of example only. Various types of fluted lens cover specifications for other automobile headlamps could be met by utilizing the method as set out herein.

The procedures and information for the photometry of automobile headlamps is set out in a book titled "Light and Color of Small Lamps", by Boris Merik and published by General Electric Company. Specific information relating to photometry can be found on pages 17, 18, 19, 124, 125, 126, 127, and 217.

SUMMARY OF THE INVENTION

The invention is a method for conforming the light distribution beam pattern projected from a sealed beam lamp having a fluted lens cover to make the beam pattern meet certain photometrics specifications.

The first step is to cover all of the total fluted lens-cover area; except, to leave only a specific area of only one flute uncovered. The portion of the flute left uncovered is then photometrically measured for its cendela output light ray pattern and progressively uncovered until the total candela output and distribution of light for its beam pattern omitting from the flute is determined. Each flute within the lens cover is progressively measured until all flutes have their individual candela and pattern measurements established. Each flute, or a portion of each flute, is then progressively left uncovered until the total light distribution pattern measured by photometry, can be shown on an isolux or isocandel diagram plotted two-dimensionally in a rectangular coordinate system. The contribution of each flute to a specific area within the beam pattern can be readily identified and omitted if it makes the seeing and glare test points of the specified illumination exceed the candela specifications for a respective test point within the pattern. Various combinations of these flutes, or portions of the flutes contributing unwanted light, are covered until a combination of covered areas are found to shape the light distribution pattern produced by the lamp to meet the test points of the photometric specification, and further determine the configuration or final shape of an opaque cover that can be easily applied as a decal, or an opaque coating applied onto an abrasive blasted or etched glass surface, or as an opaque shield located in front of the lamp to interfere with the light beam projected through the fluted lens cover and thus keep out unwanted light rays within the total beam pattern.

After determining the areas of the respective flutes to be obstructed, a final compromise of individual flutes is made to provide a desirable design shape to an opaque material or shield which will be easy to manufacture and/or apply onto the surface of the fluted lens cover, or positioned as a separate shield, to obstruct the unwanted individual light beam from interfering with the total beam distribution produced by the lamp.

Two lamps having Bureau of Standard Nos. 7706 and 5449 were modified by the methods disclosed herein. The No. 7706 lamp is a 60 watt lamp which was redesigned from a prior lamp designated by the Bureau of Standards as No. 4051, the latter being a 50 watt lamp; these lamps were identical except for the filaments which produced the differences in wattage indicated above. The No. 4051 lamp was designed by General Electric to meet SAE J582a specifications, only to find that due to the rigid requirements of the specification it was impossible to position flutes within the lens cover to direct the rays in an acceptable distribution pattern and thus GE research was discontinued. The method disclosed herein converted the even higher wattage No. 7706 lamp into an acceptable lamp. Further testing through state and Federal accepted independent laboratory tests namely Electrical Testing Institute, New York,, New York, verified the photometric specifications whereby AAMVA accepted the lamp of this invention to be legal in all member states and provinces of Canada.

The same method of reshaping the light beam distribution pattern was applied to a second lamp which was assigned No. 5449, by the Bureau of Standards, and which was unable to meet the specifications referred to above without modification by the present invention. Testing by the same approved independent laboratory, named above, resulted in the lamp No. 5449 being accepted by AAMVA as a legal lamp to be used in all member states and Canadian provinces.

DETAILED DESCRIPTION OF THE PREFERRED EMBODIMENT

Figure 1:
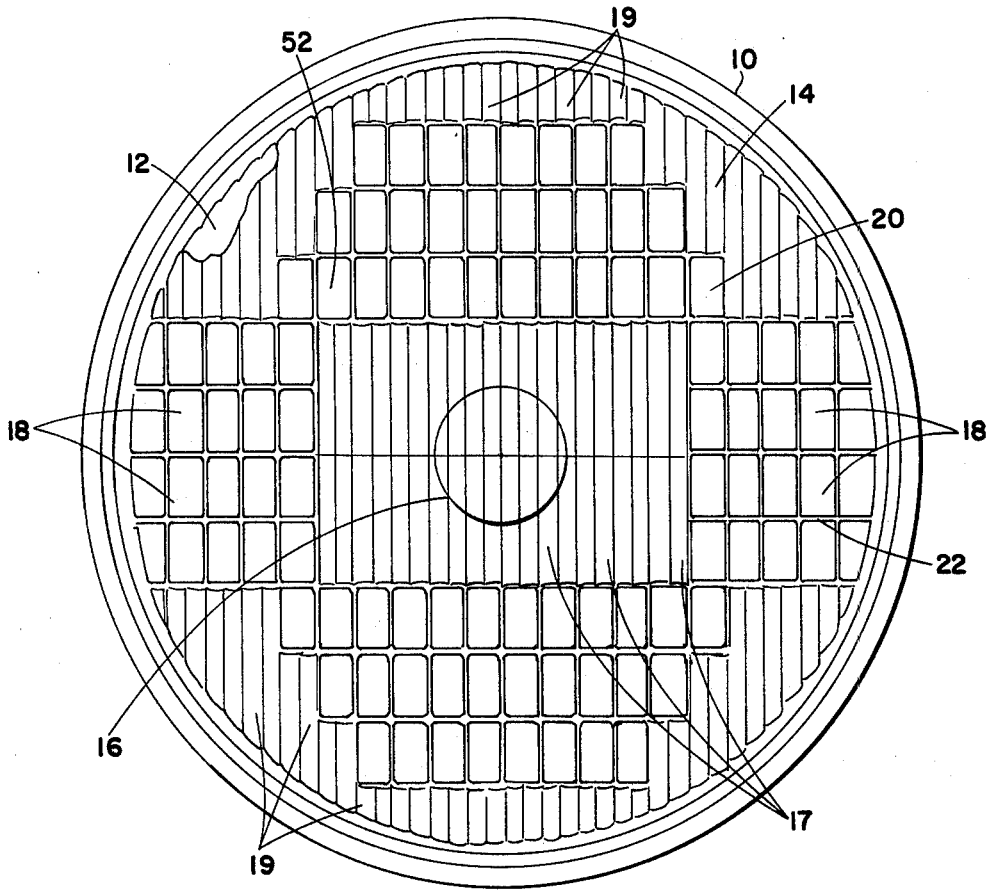
FIG. 1 is a front view of a sealed beam automotive lamp of the type 7706 prior to modification thereof by the present invention.

A specific sealed beam lamp 10, designated as a 7706 by the United States Bureau of Standards is shown in FIG. 1 in unmodified form.

The lamp 10 has a standard parabolic reflector 12 located behind a clear lens cover 14. A filament shield 16, which is barely visible through the lens cover, is shown behind the latter and is spaced above the center of the parabolic reflector 12. A filament (not shown) is positioned between the filament shield and the center of the parabolic reflector. Any suitable material which emits light in response to the passage of an electrical current there through can be utilized in the construction of the filament. Also, the parabolic reflector can be constructed of any suitable light reflecting material.

The lens cover, which is circular, is affixed to the parabolic reflector and an airtight seal is formed between the two. Both the lens cover and the parabolic reflector are continuous except that the reflector has one or more openings (not shown) through which wires or electrodes (not shown) pass to supply electrical power to the filament. The space, which enclosed by the lens cover and parabolic reflector is evacuated and a inert gas is injected therein. In other words, the lamp 10 is a standard sealed beam automotive lamp as is well known in the art.

Figure 5:
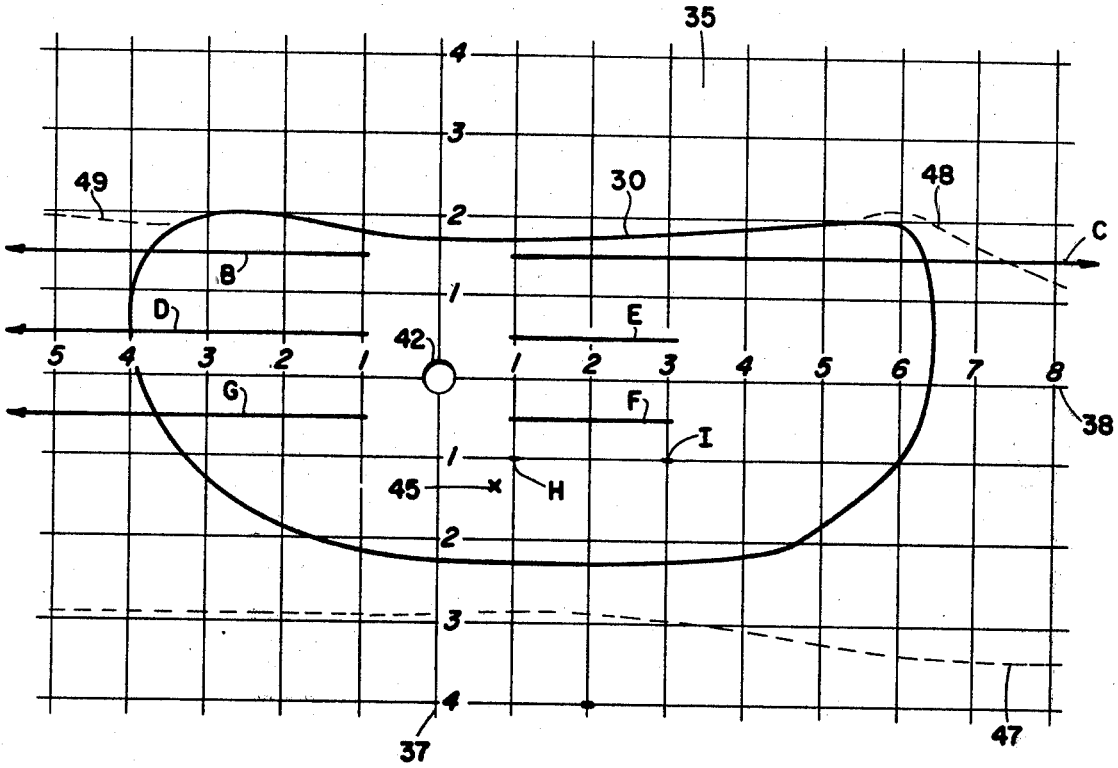
FIG. 5 shows a typical pattern of an unmodified sealed beam lamp of the type shown in FIG. 1.

The lens cover 14 is composed of a plurality of flutes 17, 18 and 19. The flutes 17 are in the shape of long narrow rectangles included in the central area of the lens cover, the flutes 18 are in the shape of shorter and wider rectangles surrounding the central area of the lens cover; and the flutes 19 are in the shape of narrow rectangles of substantially the same width as the flutes 17 but of varying length extending from the flutes 18 to the outer edge of the lens cover. These flutes, however, can be of any standard geometric shape. One individual flute 20 of the group of flutes 18 will be discussed hereinafter. The flute 20 can be of any desired geometric pattern. The flutes have boundaries between themselves, such as boundary 22, and a boundary, such as boundary 27, adjacent the periphery of the lens cover. As is well known, boundaries such as these will refract light. Thus, the flutes are set at various angles and are utilized in a sealed beam lamp lens cover to focus light. Therefore, a beam of light with a specific pattern is created. A typical beam pattern for the lamp 10 of FIG. 1 is shown in FIG. 5 and is enclosed by the line 30 (to be discussed in detail hereinafter). Each of the flutes 17, 18 and 19 directs a portion of the light generated by the filament and reflected outward from the parabolic reflector 12.

The resulting beam pattern enclosed by line 30 in FIG. 5 is of a certain shape as defined by the arrangement of the flutes, the shape of parabolic reflector, and the location of the filament and its distance from the parabolic reflector.

An auxiliary low beam head lamp, as defined in SAE J582a, must meet certain specifications as to its maximum and minimum output in candelas at various angles. These are set forth in Table I.

Table I

| Position (degrees) | Candela Maximum | Candela Minimum |
|---|---|---|
| A. 10U-90U | 150 | — |
| B. 11/2U-1L to L | 800 | — |
| C. 1½U-1R to R | 2,000 | — |
| D. ½U-1L to L | 1,000 | — |
| E. ½U-1R to 3R | 7,000 | — |
| F. ½D-1R to 3R | 50,000 | 15,000 |
| G. ½D-1L to L | 5,000 | — |
| H. 1D-1R | — | 15,000 |
| I. 1D-3R | — | 15,000 |
| J. 4D-2R | 8,000 | — |

Figure 6:
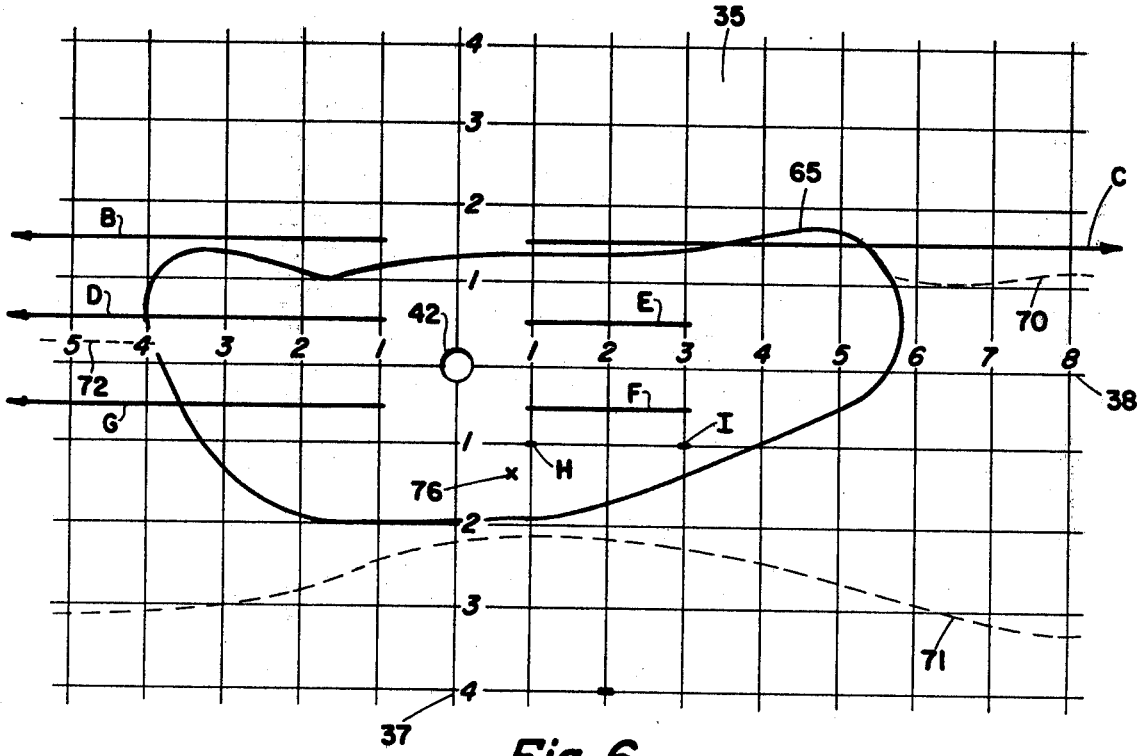
FIG. 6 shows the beam pattern produced by the modified sealed beam lamp shown in FIG. 3.

The letters A-J on the left in Table I will be used to refer to the point or line defined by its particular row. Those letters are shown in FIG. 5 and depict the various lines and points of the specification in Table I. The points in Table I are defined by a degree followed by a letter U (up) or D (down), and a degree followed by the letter R (right) or L (left). For example, point H is one degree down and one degree right from a central reference position. The lines are defined in the same way. For example, line C. is 1.5 degrees up and from 1 degree right to all the way right. Line A is not shown in FIG. 5 being from 10° up to 90° up. The same lines and points B-J are shown in FIG. 6.

The minimums present very little problems because the total output of the lamp can be increased by increasing the rated wattage of the filament. The major problem in designing the flutes involves not exceeding maximum candela requirements at certain points while still maintaining minimum candela specifications at points adjacent to the maximum.

The process of measuring the lamp beam will now be discussed. The lamp is usually placed within and locked into a frame or housing (not shown) which is adapted to measure degrees both vertically and horizontally through which the lamp is pivoted as referenced to some selected point. A large screen 35 (FIGS. 5 and 6) is placed 25 feet away from the lamp. This will make a one degree pivot of the lamp equal to five inches of movement on the screen. The screen is provided with two scales, 37 and 38, which indicate degrees vertical and horizontal, respectively.

A circular hole 42 is located at the center or at the point of intersection of the scales 37 and 38. A photometer of a photometric device (not shown) is located behind the hole at a distance of (at least) 60 feet from the lamp. The light output from the lamp passes through the hole and is measured in candelas by the photometric device as well is known in the art. For further information on this test procedure refer to pages 124 and 125 of the publication "Light and Color of Small Lamps" referred to above.

The lamp is then aimed to meet certain initial requirements. The lamp is pivoted downward and to the right so that 7000 cd (candelas) and not over that value is directed at some point on line E and 5000 cd is directed at ½° down and 1° left (the right end of line G). A typical aim point meeting these initial requirements is shown by point 45. It can be that the aim point could be upward or to the left.

The dotted lines 47, 48 and 49 represent the distribution of the slight amount of stray light which is outside the main body of the beam enclosed by line 30.

Table II shows the test results from the testing of a typical untreated lamp 10 of the type shown in FIG. 1, measured as discussed above for points and lines A-J.

TABLE II

| Position (degrees) | Output (Candelas) |
|---|---|
| A. 10U to 90U | 70.7 |
| B. 1½U-1L | 804.6 |
| C. 1½U-1R | 1,518.2 |
| 1½2U-2R | 1,729.87 |
| 1½U-3R | 1,908.5 |
| D. ½U-1L | 2,691.1 |
| E. ½U-1R | 10,035.5 |
| ½U-2R | 11,329.0 |
| ½U-3R | 11,372.9 |
| F. ½D-1R | 25,266.9 |
| ½D-2R | 32,775.1 |
| ½D-3R | 35,516.1 |
| G. ½D-1L | 6,719.6 |
| H. 1D-1R | 28,610.2 |
| I. 1D-3R | 40,503.7 |
| J. 4D-2R | 5,837.1 |

A comparison of Tables I and II discloses that this typical untreated lamp did not meet the specifications. In fact the operator was unable even to obtain an aim point which met the initial requirements. For example, point B should have a maximum of 800 cd. The data in Table I shows an output of 804.6 (cd). Point D which should have a maximum of 1000 has an output of 2691.1 (cd). Again, this lamp does not meet the specifications. It should be noted that the lines of the specifications have only been measured at certain points on the assumption that after a few degrees from the center of the beam the output in candela drops off.

To employ the method of the present invention to the lamp 10 of FIG. 1, it is necessary to cover the entire lens except for a small area. The preferred areas to leave uncovered is part or all of one of the flutes 17, 18 or 19. The area left uncovered could be, for example, flute 20. The output of flute 20 is measured at the points and lines A-J as set out in Table I. Another flute is then left uncovered, for example, flute 52.

All flutes (or parts thereof) of lens cover 14 are progressively left uncovered until all of the flutes have been left uncovered at least once and the candela output thereof measured.

Thus, the areas or portions which contribute unwanted light are identified. In other words, the flutes which direct light at the points and lines of the specification that are above the allowed maximums are systematically determined. For the lamp 10, the most critical specifications to meet is line D, (only measured at a point ½ up and 1 left) and the area contributing to a large part of the light in that direction (or angle) surrounds the flute 52. It should be noted, however, that other maximums of the specifications are exceeded by lamp 10.

Various combinations of portions and areas of the lens are systematically covered until a combination of covered portions is determined which conforms the lamp to the SAE specifications. Parts of a flute or the complete flute may be covered. There are a number of combinations which conform the lamp to the SAE specification. The combinations are of various geometric configurations and can be either continuous or divided into several parts. As set out above, the portions of the lamp contributing unwanted light in the direction of the angles where the lamp exceeds the specifications are covered in an empirical manner until at least one combination which will satisfy the SAE specification is determined. However, while conforming the output to meet the maximums, care must be taken to reduce the total output only slightly in order to meet the minimums.

Figure 3:
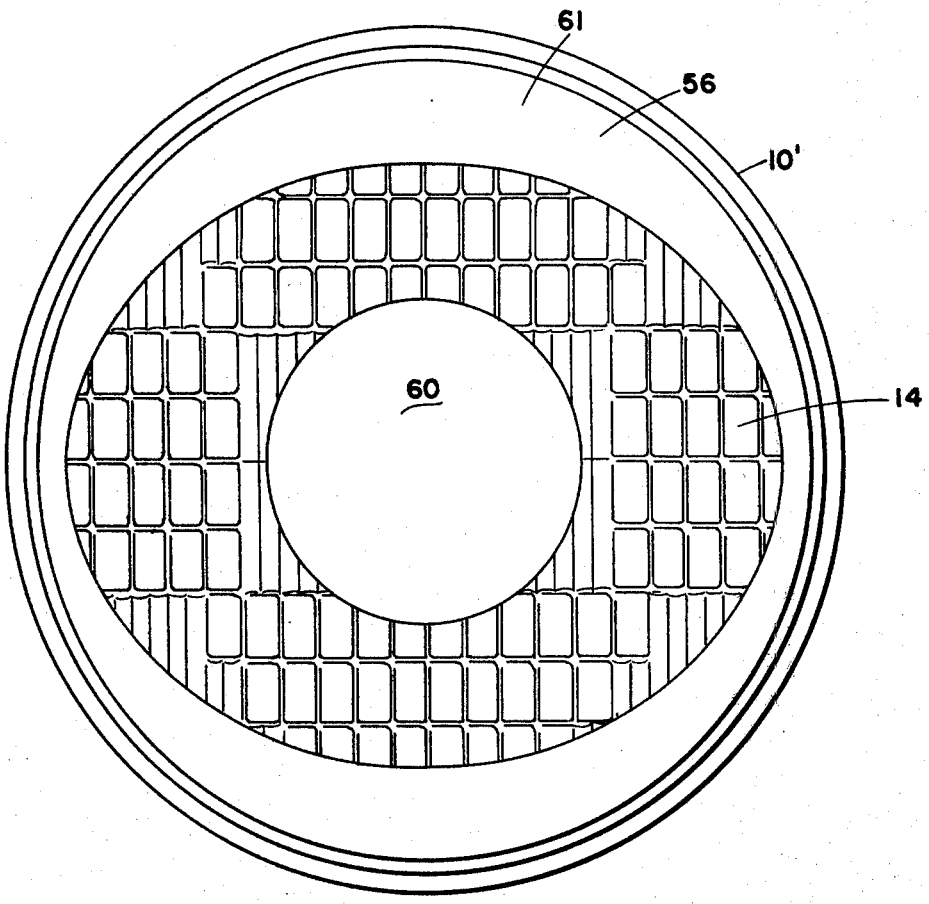
FIG. 3 is a front view of the same type of sealed beam lamp shown in FIG. 1 but with a zone plate covering portions of the lens cover as determined by the present invention.

Such a combination is shown in FIG. 3. The lamp 10 or, more properly, its lens cover 14, has been covered by a zone plate 56. The flat surface of the lens cover is circular with a radius of 2.625 inches. The zone plate, which is a combination of covered areas empirically determined, is divided into a central zone plate 60 and an outer zone plate 61. The zone plate is a covering or coating of an opaque material which is, for example, an opaque pigment or paint applied to the lens cover after the area to be coated has been etched by abrasive blasting or other suitable etching means. Also, solid opaque material such as plastic tape, plastic or metals could be utilized. The pigment used should be sufficiently opaque to significantly reduce the amount of light reflected from the parabolic reflector outward through the part of the lens covered by the zone plate 56. For example, the pigment can be black or dark blue. The shape of the outer zone plate 61 is such that it provides an opening of basically elliptical shape having minor axis radius (vertical) of two inches and a major axis radius (horizontal) of 2.375 inches, the major and minor axes having the largest and smallest radii, respectively. The center lines of the opening in the zone plate 61 are coincident with the center of the lens. The shape of the central zone plate is a circle having a radius of 1.16 inches, coincident with the center of the lens.

Table III shows the results of a test run on a typical lamp 10' after having been coated with the zone plate 56. The coating used is a black pigment. It should be noted that a ¼° re-aim is allowed by the SAE J582a specification and that re-aim allowance was used on ½ U-3R of line E.

For example, the line D at ½° up and 1° left has a measured output of 940.0 candela which is less than the 1000 maximum allowed. Another example is that point I is above the 15,000 minimum required.

Table III

| Position (degrees) | Output Candelas(cd) |
|---|---|
| A. 10U-90U | 18.6 |
| B. 1½U-1L | 213.2 |
| 1½U-1R | 549.7 |
| C. 1½2U-2R | 669.7 |
| 1½U-3R | 737.2 |
| D. ½U-1L | 940.0 |
| E. ½U-1R | 5,502.8 |
| ½U-2R | 6,916.0 |
| ½U-3R | 7,000.0 |
| F. ½D-1R | 17,473.0 |
| ½D-2R | 22,471.6 |
| ½D-3R | 24,499.6 |
| G. ½D-1L | 3,085.0 |
| H. 1D-1R | 21,430.3 |
| I. 1D-3R | 30,199.6 |
| J. 4D-2R | 3,864.02 |

A comparison between Table I and Table III shows that the lamp now conforms to the specification. The addition of the zone plate to the lens cover has reshaped the beam so that it now conforms to the specifications. In other words, the beam of light passing through the area of the lamp without a covering or coating has been reshaped to meet the specifications.

The results of Table III have been plotted on FIG. 6. The line 65 of FIG. 6 encloses an outline of the beam pattern of the lamp 10' after it is coated and the beam thereof reshaped by the method of the present invention. Dotted lines 70, 71 and 72 represent a penumbra of faint stray light which is outside the main body of the beam and has no significant value to the specifications. Point 76 is a typical aim point for the lamp in order to meet the initial requirements for aiming as set forth above.

As can be appreciated by a comparison of FIG. 6 with FIG. 5, the beam shape (pattern) has been altered by the application of the zone plate. The beam is smaller and as shown in Table III, the critical line D is below the 1000 (cd) allowed by the specification. Line D is the glare area where light rays strike the eyes of the driver of an oncoming automobile.

In summary, the lamp is affixed into a housing and aimed to meet certain initial requirements. The output of the lamp in candelas is read photometrically at the various points and lines set forth as degrees in a specification. An area of the lens cover, such as a flute, is left uncovered and the output measured at the various points and lines. Then, other portions are progressively measured until all areas of the lens cover are individually measured. The areas contributing output to those points and lines where the lamp exceeds the specifications are identified. Various combinations of covering those areas or parts thereof are tried until a combination is determined that conforms the lamp to the specifications.

Figure 2:
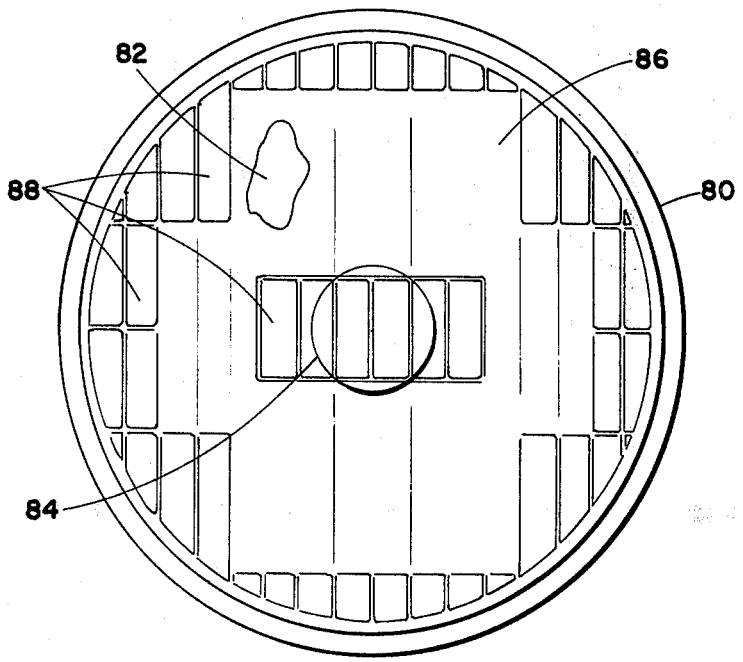
FIG. 2 is a front view of a sealed beam automotive lamp of the type 5449 prior to modification thereof by the present invention.

A second example of the application of the method is set out here below. A lamp 80 is shown in FIG. 2. Lamp 80 is a sealed beam lamp of smaller size than the lamp 10 and designated as a No. 5449 by the Bureau of Standards. This No. 5449 lamp, which is rated at 30 watts, was unable to meet the specifications referred to above until modified by the present invention as will appear hereinafter. The lamp 80 has a parabolic reflector 82, a filament shield 84, a filament (not shown), and a lens cover 86. The lens cover 86 has a number of flutes 88. The outer surface of the lens cover is circular with a diameter of 4.0 inches.

The lamp 80 is placed in a housing and pivoted to meet the initial requirements. Those initial requirements are that the lamp in housing is rotated so that 7000 cd, and not over that value, is directed at ½° up at some point between 1 and 3 degrees right, and 5000 cd is directed at ½° down at 1 degree left. Table IV shows the output of a typical lamp 80.

Table IV

| Position(degrees) | Output Candelas (cd) |
|---|---|
| A. 10U to 90U | 36.7 |
| B. 1½U-1L | 321.2 |
| C. 1½U-1R | 709.8 |
| 1½U-2R | 909.8 |
| 1½U-3R | 895.0 |
| D. ½U-1L | 1,224.4 |
| E. ½U-1R | 5,174.0 |
| ½U-2R | 5,848.1 |
| ½U-3R | 5,174.0 |
| F. ½D-1R | 20,060.0 |
| ½D-2R | 19,703.8 |
| ½D-3R | 16,168.6 |
| G. ½D-1L | 4,318.9 |
| H. 1D-1R | 26,253.4 |
| I. 1D-3R | 21,430.3 |
| J. 4D-2R | 1,676.6 |

The typical lamp 80 does not meet the specifications of Table I. For example, line D has a measurement of 1224.4 (cd) which is over the maximum of 1000 (cd) set forth in Table I. To employ the invention, each of the flutes 88 is progressively left uncovered while the remainder of the lens cover 86 is covered. The portions of the area of the lens not fluted are also left uncovered in their turn for measurement until all portions of the entire lens have been left uncovered at least once. The portions of the lens which contribute output toward the points and lines where the lamp exceeds the maximums of the specifications are identified. Various combinations of these portions or areas thereof, and other portions of the lens cover are covered until at least one combination is empirically found which conforms the lamp to the specification.

Figure 4:
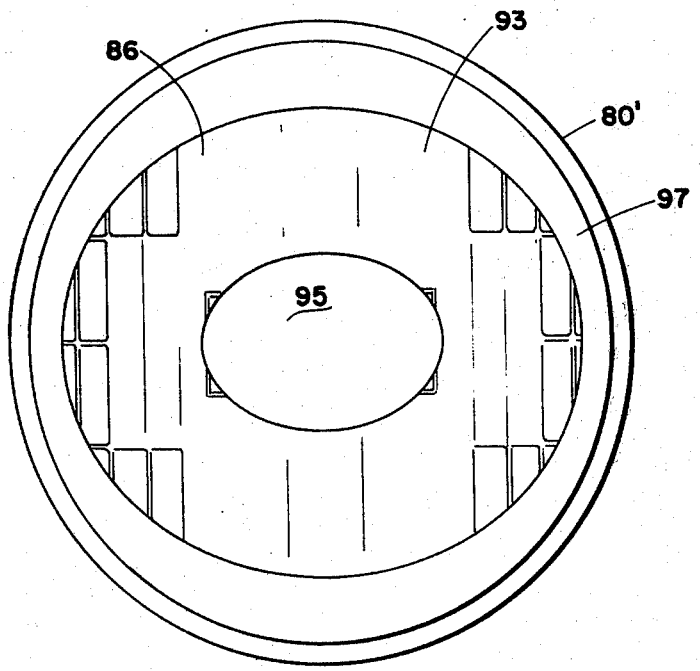
FIG. 4 is a front view of the same type of sealed beam lamp shown in FIG. 2 but with a zone plate placed thereon as determined by the present invention.

FIG. 4 shows the lamp 80' (the same lamp 80 of FIG. 2 but now modified) with a zone plate 93 determined by the method of the present invention. The zone plate 93 is divided and comprises two parts, a central zone plate 95 and an outer zone plate 97. Both zone plates are centered on the lens cover. The central zone plate 95 has a basically elliptical shape having a major axis diameter (horizontal) of 1.750 inches and a minor axis diameter (vertical) of 1.25 inches. The interior edge or opening of the outer zone plate 97 has a basically elliptical shape having a major axis diameter (horizontal) of 3.75 inches and a minor axis diameter (vertical) of 3.3 inches.

The zone plate 93 of lamp 80' is applied in a manner similar to the application of zone plate 56 to lens cover 14. The lamp 80' of FIG. 4 was tested after the zone plate was applied (in the same manner as the lamp of FIG. 3) and the results are shown in Table V appearing below.

Table V

| Position (degrees) | Output Candelas (cd) |
|---|---|
| A. 10U-90U | 78.9 |
| B. 1½U-1L | 356.8 |
| C. 1½U-1R | 649.5 |
| 1½U-2R | 754.2 |
| 1½U-3R | 752.0 |
| D. ½U-1L to L | 876.0 |
| E. ½U-1R | 5,437.0 |
| ½U-2R | 6,122.1 |
| ½U-3R | 5,557.6 |
| F. ½D-1R | 18,761.1 |
| ½D-2R | 21,430.3 |
| ½D-3R | 19,506.5 |

Table V-continued

| Position (degrees) | Output Candelas (cd) |
|---|---|
| G. ½D-1L | 4,861.5 |
| H. 1D-1R | 24,335.1 |
| I. 1D-3R | 25,102.4 |
| J. 4D-2R | 3,447.5 |

A comparison of Table V with Table I shows that the lamp 80' with the zone plate 93 now passes the specifications. With respect to the smaller lamp 80 or 80' of FIGS. 2 and 4 it should be noted that no beam patterns (before and after) are provided such as shown in FIGS. 5 and 6 because such beam patterns would be essentially similar.

Thus, two different varieties of lamps are conformed to a set of specifications by the use of the method of the present invention. Further, the method does not alter (or only slightly, if at all) the chromaticity of the lamps and they comply with J 578a and b and Title 13, Section 626(a) of the California Administrative Code.

Whereas, the present invention has been described in particular relation to the drawings attached hereto, it should be understood that other sealed beam lamp shapes, such as the rectangular shape of new head lamps introduced recently and further modifications, apart from those shown or suggested herein, may be made within the spirit and scope of this invention.

What is claimed is:

1. A method of altering the photometric output and distribution of a lamp beam from an auxiliary automobile headlamp of the type having a fluted lens cover and wherein said lamp beam is directed outward from said lamp through its lens cover comprising the steps of covering a central portion of said lens cover with an opaque material and covering a peripheral portion of said lens cover with an opaque material whereby the resulting lamp beam conforms to certain specifications requiring said beam to have less than certain maximum outputs at certain angles referenced to said lamp and wherein said beam exceeds certain minimum outputs along a number of other angles referenced to said lamp to conform with SAE Standards J582a.

2. A method as set forth in claim 1 wherein said lens cover has a flat circular surface with a radius of approximately 2.625 inches, wherein the central portion of said lens cover is covered with an opaque material in a central circular area having a radius of about 1.16 inches and wherein the peripheral portion of said lens cover is covered with opaque material having an interior edge of basically elliptical shape with a minor axis radius of 2.0 inches and a major axis radius of 2.375 inches.

3. A method as set forth in claim 1 wherein said lens cover has an outer circular surface with a diameter of approximately 4.0 inches, wherein the central portion of said lens cover is covered with an opaque material in a central elliptical area having a major horizontal axis diameter of 1.75 inches and a minor vertical axis diameter of 1.25 inches and wherein the peripheral portion of said lens cover is covered with opaque material having an interior edge of basically elliptical shape with a major horizontal axis diameter of 3.75 inches and a minor vertical axis diameter of 3.3 inches.

4. A modified auxiliary automobile headlamp of the type designated as 7706 by the United States Bureau of Standards in unmodified form and wherein said headlamp has a lens cover with a flat circular surface of radius equal to approximately 2.625 inches comprising, in combination with said headlamp, a circular cover of opaque material centrally disposed with respect to said lens cover and having a radius of about 1.16 inches, and a peripheral covering of opaque material on said lens cover and centered with respect thereto, said peripheral covering having an interior edge of basically elliptical shape with a minor axis radius of 2.0 inches and a major axis radius of 2.375 inches.

5. A modified auxiliary automobile headlamp of the type designated as 5449 by the United States Bureau of Standards in unmodified form and wherein said headlamp has a lens cover with an outer circular surface of diameter equal to approximately 4.0 inches comprising, in combination with said headlamp, an elliptical cover of opaque material centrally disposed with respect to said lens cover and having a major horizontal axis diameter of 1.75 inches and a minor vertical axis diameter of 1.25 inches, and a peripheral covering of opaque material on said lens cover and centered with respect thereto, said peripheral covering having an interior edge of basically elliptical shape with a major horizontal axis diameter of 3.75 inches and a minor vertical axis diameter of 3.3 inches.

* * * * *